US009146457B2

(12) United States Patent
Kim et al.

(10) Patent No.: US 9,146,457 B2
(45) Date of Patent: Sep. 29, 2015

(54) ELECTRO-PHOTOGRAPHIC PHOTORECEPTOR AND IMAGE FORMING APPARATUS INCLUDING THE SAME

(71) Applicant: SAMSUNG ELECTRONICS CO., LTD., Suwon-si (KR)

(72) Inventors: Seung-ju Kim, Suwon-si (KR); Ji-uk Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 20 days.

(21) Appl. No.: 14/043,144

(22) Filed: Oct. 1, 2013

(65) Prior Publication Data

US 2014/0302431 A1 Oct. 9, 2014

(30) Foreign Application Priority Data

Apr. 3, 2013 (KR) ..... 10-2013-0036440

(51) Int. Cl.

| | |
|---|---|
| ***G03G 5/00*** | (2006.01) |
| ***G03C 1/76*** | (2006.01) |
| ***G03G 5/05*** | (2006.01) |
| *G03G 15/00* | (2006.01) |

(52) U.S. Cl.

CPC ..... *G03C 1/76* (2013.01); *G03G 5/0564* (2013.01); *G03G 5/0578* (2013.01); *G03G 15/75* (2013.01)

(58) Field of Classification Search

CPC ..... G03G 5/0578
USPC ..... 430/59.6; 399/159
See application file for complete search history.

(56) References Cited

U.S. PATENT DOCUMENTS

| | | | | |
|---|---|---|---|---|
| 3,980,494 | A | 9/1976 | Beatty et al. | |
| 5,162,183 | A | 11/1992 | Lindblad et al. | |
| 5,252,418 | A | 10/1993 | Ishikawa et al. | |
| 6,130,018 | A | 10/2000 | Kawata et al. | |
| 6,203,962 | B1 | 3/2001 | Itami et al. | |
| 6,444,387 | B2 | 9/2002 | Ri et al. | |
| 2001/0012594 | A1 | 8/2001 | Ri et al. | |
| 2002/0018948 | A1 * | 2/2002 | Takeshima et al. | 430/58.2 |
| 2007/0054207 | A1 * | 3/2007 | Kimura | 430/58.2 |
| 2011/0014563 | A1 | 1/2011 | Kim et al. | |
| 2012/0201585 | A1 | 8/2012 | Hu et al. | |

* cited by examiner

*Primary Examiner* — Mark A Chapman
(74) *Attorney, Agent, or Firm* — Staas & Halsey LLP

(57) ABSTRACT

Provided is a photoreceptor having an appropriate surface frictional force that enables a cleaning angle, at which the slipping between the surface of the photoreceptor surface and the blade is prevented and the overturning and vibrating of the blade are prevented, to be easily obtained.

26 Claims, 1 Drawing Sheet

ELECTRO-PHOTOGRAPHIC PHOTORECEPTOR AND IMAGE FORMING APPARATUS INCLUDING THE SAME

CROSS-REFERENCE TO RELATED APPLICATIONS

This application claims the benefit of Korean Patent Application No. 10-2013-0036440, filed on Apr. 3, 2013, in the Korean Intellectual Property Office, the disclosure of which is incorporated herein in its entirety by reference.

BACKGROUND

1. Field

The present disclosure concept relates to an electro-photographic photoreceptor (hereinafter, referred to as a photoreceptor) that is used in an electro-photographic image forming apparatus (for example, a fax machine, a copying machine, a laser printer, a CRT printer, a LED printer, a liquid crystal printer, or the like). Also, the present general inventive concept relates to an image forming apparatus including a photoreceptor.

2. Description of the Related Art

A photoreceptor includes a conductive support, and a photoreceptor layer formed on the conductive support.

A photoreceptor layer is largely classified as a stack-type photoreceptor layer and a single layer-type photoreceptor layer. The stack-type photoreceptor layer includes: a charge generation layer including a binder resin and a charge-generating material (CGM); and a charge transport layer including a binder resin and a charge-transporting material (CTM, for example, a hole-transporting material). The stack-type photoreceptor layer is applied to a negative charge-type photoreceptor. The single layer-type photoreceptor layer includes a binder resin, a CGM, and a CTM, which are all included in a single layer, and is applied to a positive charge-type photoreceptor.

In an electro-photographic image forming apparatus, an electrostatic latent image is formed on the surface of a photoreceptor, toner is attached to the electrostatic latent image, which is then developed into a toner image. The toner image on the surface of the photoreceptor is transferred onto a sheet of paper. The residual toner that remains on the surface of the photoreceptor and not transferred is removed from the surface of the photoreceptor by a blade formed of a rubber material.

FIG. 1 is an example of the configuration of a photoreceptor 100 and a blade 200. The blade 200 formed of planar rubber or synthetic rubber is fixed on a rigid blade support 300. The photoreceptor 100 and the blade 200 contact each other at a predetermined angle. When the angle between the photoreceptor 100 and the blade 200, that is, a cleaning angle θ, increases, the residual ink or toner may be more easily removed. However, when the cleaning angle θ exceeds a certain range, the blade 200 may overturn, deform, or vibrate, leading to failing to remove toner.

Conventionally, the cleaning angle is determined by trial and error to prevent the overturning and vibrating of a blade. Also, conventionally, when a photoreceptor is manufactured, a frictional force on the surface of the photoreceptor is not considered, and only photoreceiving characteristics and abrasive characteristics are taken into consideration. Most conventional photoreceptors have a surface frictional force of 100 gf or more, which is measured by a surface friction measurement apparatus illustrated in FIG. 2, although some of them have a surface frictional force of less than 30 gf.

SUMMARY

Additional aspects and/or advantages will be set forth in part in the description which follows and, in part, will be apparent from the description, or may be learned by practice of the invention.

According to the present disclosure, when a frictional force of the photoreceptor surface is less than 30 gf, at some cleaning angles, slipping occurs between the surface of a photoreceptor and a blade, thereby failing to remove the residual ink or toner. Slipping occurs between an electrifying roller and the photoreceptor and thus, the formed image has defects due to defective charging. Also, according to the present disclosure, when a frictional force of the surface of the photoreceptor is 100 gf or more, the blade may overturn or vibrate. The vibration of the blade causes noise. Accordingly, in photoreceptors, it is very difficult to obtain a cleaning angle at which the slipping between the surface of the photoreceptor and the blade is prevented and the overturning and vibrating of the blade are prevented.

The present disclosure provides a photoreceptor having an appropriate surface frictional force that enables a cleaning angle, at which the slipping between the surface of the photoreceptor and the blade is prevented and the overturning and vibrating of the blade are prevented, to be easily obtained.

According to an embodiment of a photoreceptor according, the photoreceptor includes a conductive support; and a photoreceptor layer that is disposed on a surface of the conductive support and includes a charge-generating material, a charge-transporting material, and a binder resin, wherein the binder resin includes a first binder resin that contains a repeating unit represented by Formula 1 and a second binder resin that does not contain the repeating unit represented by Formula 1:

<Formula 1>

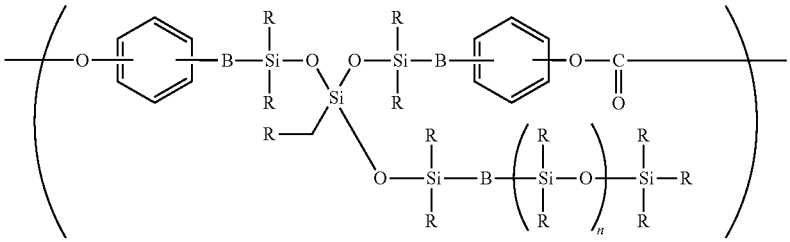

wherein the respective R are each independently a C1 to C6 alkyl group, a C1 to C6 alkenyl group, a C1 to C6 alkynyl group, or a C6 to 11 aryl group, B is —$(CH_2)_Z$—, Z is 2 to 6, and n is 0 to 200.

According to an embodiment of a photoreceptor according, the photoreceptor includes: a conductive support; a charge generation layer that is disposed on the conductive support and includes a binder resin and a charge-generating material; and a charge transport layer that is disposed on the charge generation layer and includes a binder resin and a charge-transporting material, wherein the binder resin of the charge transport layer includes a first binder resin that contains a repeating unit represented by Formula 1 and a second binder resin that does not contain the repeating unit represented by Formula 1:

<Formula 1>

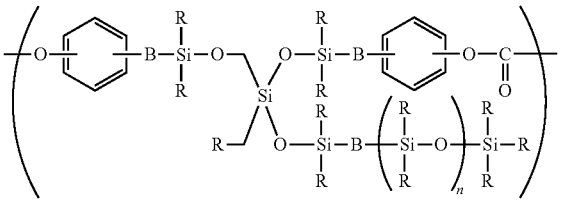

wherein the respective R are each independently a C1 to C6 alkyl group, a C1 to C6 alkenyl group, a C1 to C6 alkynyl group, or a C6 to 11 aryl group, B is —$(CH_2)_Z$—, Z is 2 to 6, and n is 0 to 200.

According to an embodiment of a photoreceptor, the photoreceptor includes a conductive support; and a charge transport layer that is disposed on the conductive support and includes a binder resin and a charge-transporting material; and a charge generation layer that is disposed on the charge transport layer and includes a binder resin and a charge-generating material, wherein the binder resin of the charge generation layer includes a first binder resin that contains a repeating unit represented by Formula 1 and a second binder resin that does not contain the repeating unit represented by Formula 1:

<Formula 1>

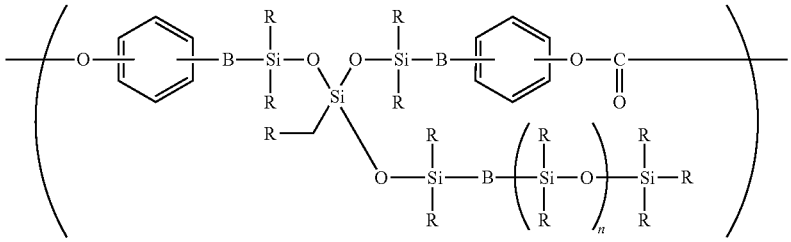

wherein the respective R are each independently a C1 to C6 alkyl group, a C1 to C6 alkenyl group, a C1 to C6 alkynyl group, or a C6 to 11 aryl group, B is —$(CH_2)_Z$—, Z is 2 to 6, and n is 0 to 200.

According to an embodiment of an electro-photographic image forming apparatus includes a photoreceptor and a cleaning blade, wherein the photoreceptor is any one of the photoreceptors according an embodiment.

BRIEF DESCRIPTION OF THE DRAWINGS

The above and other features and advantages will become more apparent by describing in detail exemplary embodiments thereof with reference to the attached drawings in which.

DETAILED DESCRIPTION

Figure 1:
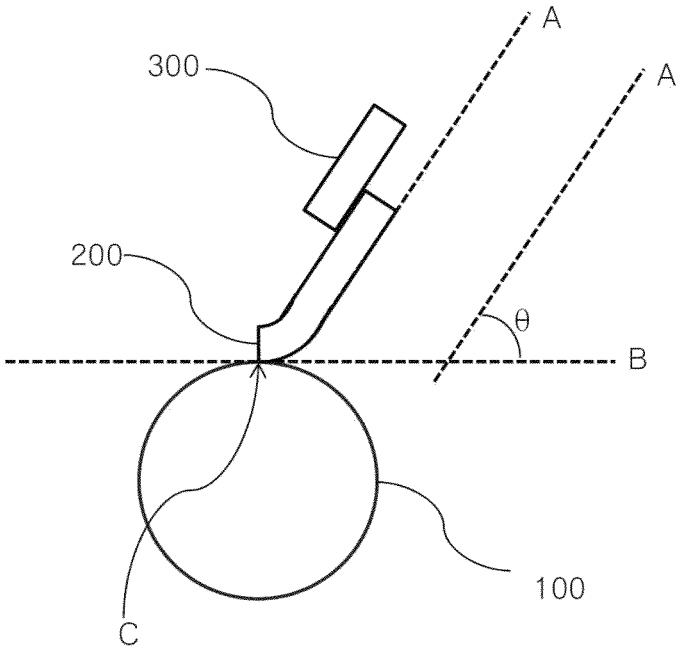
FIG. 1 is a typical example of the configuration of a photoreceptor and a blade.

The present disclosure will now be described more fully with reference to the accompanying drawings, in which exemplary embodiments of the present general inventive concept are shown. Expressions such as "at least one of," when preceding a list of elements, modify the entire list of elements and do not modify the individual elements of the list.

Hereinafter, an embodiment of a photoreceptor is described in detail. A photoreceptor according to the present embodiment includes a conductive support, and a photoreceptor layer that is disposed on a surface of the conductive support and includes a charge-generating material, a charge-transporting material, and a binder resin.

The conductive support may be any one of various conductive materials. The conductive support may be, for example, metal or a conductive polymer. The shape of the conductive support may be, for example, a plate, a disc, a sheet, a belt, or a drum. The metal may be, for example, aluminum, vanadium, nickel, copper, zinc, palladium, indium, tin, platinum, stainless steel, or chromium. The conductive polymer may be, for example, a dispersion of a conductive material, such as conductive carbon, tin oxide, indium oxide, in a polyester resin, a polycarbonate resin, a polyamide resin, a polyimide resin, a mixture thereof, or a copolymer resin thereof. Also, a metal sheet or an organic polymer sheet having deposited or laminated metal may be used.

A conductive layer and/or an intermediate layer may be further formed on the conductive support. The conductive layer may be, for example, a dispersion of conductive powder, such as carbon black, graphite, metal powder, or metal oxide powder, for example, $TiO_2$, in a binder resin, such as polyamide. A thickness of the conductive layer may be in a range of about 5 to about 50 μm.

The intermediate layer is formed to improve an adhesive property, or block the charge injection from a support. The intermediate layer may be, for example, an anodized aluminum layer; a resin dispersion layer of metal oxide powder, such as titanium oxide or tin oxide; or a resin layer, such as polyvinyl alcohol, casein, ethyl cellulose, gelatin, a phenol resin, or polyamide, but it is not limited thereto. A thickness of the intermediate layer may be in a range of about 0.05 to about 5 μm.

The photoreceptor layer, including a charge-generating material, a charge-transporting material, and a binder resin, may be disposed on the conductive support. Accordingly, the photoreceptor layer constitutes a surface of the photoreceptor.

The charge-generating material may be any one of various charge-generating materials, and may be, for example, a phthalocyanine-based pigment, an azo-based compound, a bisazo-based compound, a triazo-based compound, a quinone-based pigment, a perylene-based compound, an indigo-based compound, a bisbenzoimidazole-based pigment, an antraquinone-based compound, a quinacridone-based compound, an azulenium-based compound, a squarylium-based compound, a pyrylium-based compound, a triarylmethane-based compound, a cyanine-based compound, a perinone-based compound, a polycycloquinone compound, a pyrrolopyrrol compound, or a naphthalocyanine compound. These materials may be used alone or in combination. The charge-generating material may be a phthalocyanine-based pigment. The phthalocyanine-based pigment may be a titanyloxyphthalocyanine pigment, such as D-type or Y-type titanyloxyphthalocyanine having the strongest diffraction peak at a Brag angle (2θ±0.2°) of about 27.1° in a powder X-ray diffraction spectrum, β-type titanyloxyphthalocyanine having the strongest diffraction peak at a Brag angle (2θ±0.2°) of about 26.1° in a powder X-ray diffraction spectrum, or alpha-type titanyloxyphthalocyanine having the strongest diffraction peak at a Brag angle (2θ±0.2°) of about 7.5° in a powder X-ray diffraction spectrum; or a non-metal phthalocyanine pigment, such as an X-type non-metal phthalocyanine or τ(tau)-type non-metal phthalocyanine having the strongest diffraction peak at a Brag angle (2θ±0.2°) of about 7.5° and about 9.2°, respectively, in a powder X-ray diffraction spectrum. These phthalocyanine-based pigments have excellent photoreceiving properties in a wavelength of 780 nm to 800 nm; and according to a crystal structure thereof, a photoreceiving degree may vary in a desirable range. Accordingly, they may be effectively used in embodiments of the present general inventive concept.

An amount of the charge-generating material in the photoreceptor layer may be in a range of, for example, about 50 parts by weight to about 300 parts by weight based on 100 parts by weight of the binder resin including the first binder resin and the second binder resin. When the amount of the charge-generating material in the photoreceptor layer is too small, charge generation efficiency may decrease. On the other hand, when the amount of the charge-generating material in the photoreceptor layer is too high, a generated charge may be trapped and thus, image quality may decrease and also a binding force thereof may decrease.

As the charge-transporting material, a hole-transporting material that transports holes and an electron-transporting material that transports electrons may be used. When a photoreceptor is used as a negative (−) charge type photoreceptor, a hole-transporting material may be used as the charge-transporting material, and also, when a positive (+)/negative (−) charge type photoreceptor is required, a hole-transporting material and an electron-transporting material may be mixed for use.

The hole-transporting material may be, for example, a hydrazone-based compound, a butadiene-based amine compound, a benzidine-based compound, such as N,N'-bis-(3-methylphenyl)-N,N'-bis(phenyl)benzidine, N,N,N',N'-tetrakis(3-methylphenyl)benzidine, N,N,N',N'-tetrakis(4-methylphenyl)benzidine, N,N'-di(naphthalene-1-yl)-N,N'-di(4-methylphenyl)benzidine, or N,N'-di(naphthalene-2-yl)-N,N'-di(3-methylphenyl)benzidine, a pyrene-based compound, a carbazole-based compound, an arylmethane-based compound, a thiazole-based compound, a styryl-based compound, a pyrazoline-based compound, a styryl-based compound, an arylamine-based compound, an oxazole-based compound, an oxadiazole-based compound, a pyrazoline-based compound, a pyrazolone-based compound, a stylbene-based compound, a polyaryl alkan-based compound, a polyvinylcarbazole-based compound, an N-acrylamidemethylcarbazole polymer, a triphenylmethane polymer, a styrene copolymer, polyacenaphthen, polyindene, a copolymer of acenaphthylene and styrene, a nitrogen-containing cyclic compound of a formaldehyde-based condensed resin, a condensed polycyclic compound, or a polymer compound having their derivatives at a backbone or a side chain thereof.

The electron-transporting material may be, for example, an electron receiving low molecular compound, such as a benzoquinone-based compound, a naphtoquinone-based compound, an anthraquinone-based compound, a malononitrile-based compound, a fluorenone-based compound, a cyanoethylene-based compound, a cyanoquinodimethane-based compound, a xanthone-based compound, a phenanthra quinone-based compound, an anhydrous phthalic acid-based compound, a thiopyrane-based compound, a dicyanofluorenone-based compound, a diimide naphthalenetetracarboxylate compound, a benzoquinoneimine-based compound, a diphenoquinone-based compound, a stylbene quinone-based compound, a diiminoquinone-based compound, a dioxotetracendion compound, or a pyran sulfide-based compound.

An amount of the charge-transporting material in the photoreceptor layer may be in a range of, for example, about 10 parts by weight to about 60 parts by weight based on 100 parts by weight of the binder resin including the first binder resin and the second binder resin. When the amount of the charge-transporting material in the photoreceptor layer is too small, charge transportation efficiency of the photoreceptor layer may decrease. When an amount of the charge-transporting material in the photoreceptor layer is too high, an amount of the binder resin is relatively small and thus, a mechanical strength of the photoreceptor layer may decrease.

The binder resin includes the first binder resin that contains the repeating unit represented by Formula 1 and the second binder resin that does not contain the repeating unit represented by Formula 1:

<Formula 1>

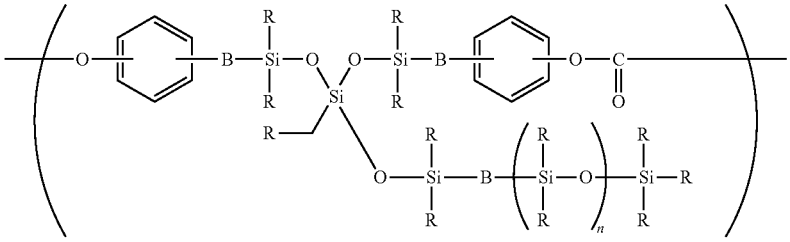

wherein the respective R are each independently a C1 to C6 alkyl group, alkenyl group, or alkynyl group, or a C6 to C11 aryl group, B is —$(CH_2)_Z$—, Z is 2 to 6, and n is 0 to 200.

The first binder resin containing a repeating unit represented by Formula 1 reduces a frictional force. A frictional force caused by the second binder resin that does not contain the repeating unit represented by Formula 1 may be reduced due to the first binder resin that contains the repeating unit represented by Formula 1.

The first binder resin may be, for example, a binder resin represented by Formula 2 below, a binder resin represented by Formula 3 below, a binder resin represented by Formula 4 below, or a mixture thereof.

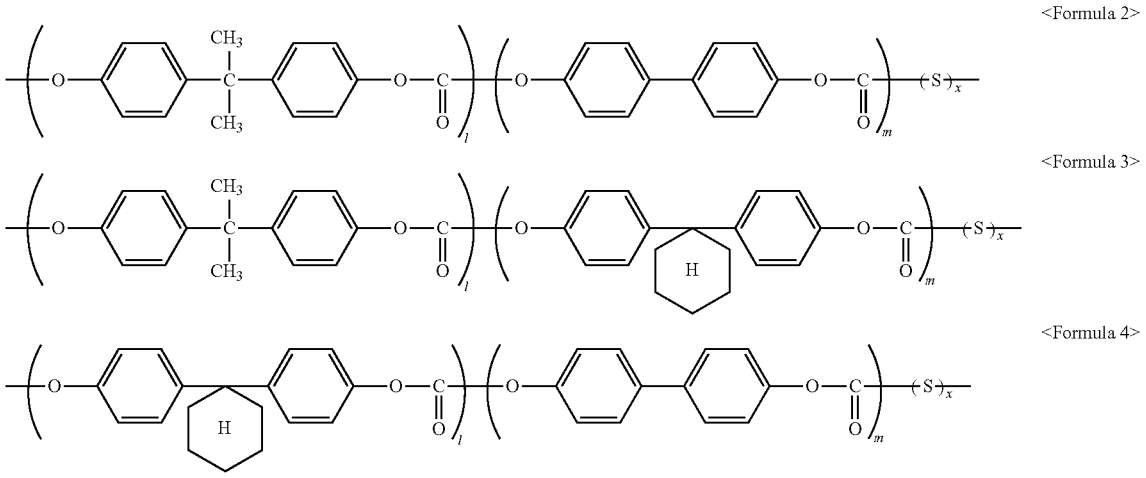

In Formulae 2, 3, and 4, S is the repeating unit represented by Formula 1, and x/(l+m+x) is in a range of about 0.001 to about 0.01. x may be, for example, in a range of about 1 to about 50. l may be, for example, in a range of about 1 to about 50. m may be, for example, in a range of about 1 to about 50. The repeating unit S is a silicon-containing functional group and may contribute to a decrease in surface energy. To further decrease a frictional force, x/(l+m+x) may be in a range of about 0.001 to about 0.005.

A weight average molecular weight of the first binder resin may be in a range of, for example, about 20,000 to about 100,000. When a weight average molecular weight of the first binder resin is too small or too great, the photoreceptor layer may not be formed well.

The second binder resin is a binder resin that does not contain the repeating unit represented by Formula 1. The second binder resin may be, for example, an insulating resin, such as polyvinyl butyral, polyarylate (a condensed polymer of bisphenol A and phthalic acid), polycarbonate, a polyester resin, a phenoxy resin, polyvinyl acetate, an acryl resin, a polyacrylamide resin, polyamide, polyvinyl pyridine, a cellulose-based resin, a urethane resin, an epoxy resin, a silicon resin, polystyrene, polyketone, polyvinyl chloride, a vinyl chloride-a vinyl acid copolymer, polyvinyl acetal, polyacrylonitrile, a phenol resin, a melamine resin, casein, a polyvinyl alcohol, or a polyvinyl pyrrolidone, or an organic photoconductive resin, such as poly N-vinylcarbazole, polyvinyl anthracene, or polyvinylpyrene.

A weight ratio of the first binder resin to the second binder resin in the photoreceptor layer may be in a range of about 5:5 to about 9:1. In detail, the weight ratio of the first binder resin to the second binder resin may be in a range of about 6:4 to about 8:2. When the amount of the first binder resin is too high the photoreceptor layer may have too small a surface frictional force of, for example, less than about 30 gf. When the amount of the first binder resin is too low, the photoreceptor layer may have too high a surface frictional force of, for example about, more than 100 gf.

A solvent that is used in preparing a coating slurry for forming the photoreceptor layer may be any one of various solvents that dissolve the binder resin and do not affect an adjacent layer during coating for forming a photoreceptor layer. Examples of a possible solvent are methyl isopropyl ketone, methyl isobutyl ketone, 4-methoxy-4-methyl-2-pentanone, isopropyl acetate, tertiary butyl acetate, methyl ethyl ketone, cyclohexanone, 1,2-dichloroethane, 1,1,2-trichloroethane, 1,1,1-trichloroethane, trichloroethylene, tetrachloroethane, dichloromethane, tetrahydrofurane, dioxane, dioxolane, ethyl acetate, and butyl acetate. These solvents may be used alone or in combination thereof. In preparing a coating slurry for forming a photoreceptor layer, an amount of the solvent may be, for example, in a range of about 500 parts by weight to about 2,000 parts by weight based on 100 parts by weight of a total of the charge-generating material, the charge-transporting material, and the binder resin.

The coating slurry for forming the photoreceptor layer may be coated on the conductive support. The coating method may be soaking coating, ring coating, roll coating, or spray coating. The conductive support coated with the coating slurry may be dried at a temperature of about 90 to about 200° C. for about 0.1 to about 2 hours to form a photoreceptor layer A thickness of the photoreceptor layer may be in a range of, for example, about 1 to about 50 μm, about 10 to about 40 μm, or about 15 to about 40 μm. When a thickness of the photoreceptor layer is too small, charges may not be efficiently generated, and when a thickness of the photoreceptor layer is too great, charges may not be moved well and may be trapped, thereby leading to a decrease in image quality. A smaller thickness of the photoreceptor layer may lead to a higher image quality. However, when a thickness of the photoreceptor layer is too small, due to wear caused by use, a lifespan of the photoreceptor layer may be reduced. A greater thickness of the photoreceptor layer may lead to a longer lifespan of the photoreceptor. However, when the thickness of the photoreceptor layer is too great, generated charges are not moved well and are trapped, leading to a decrease in image quality.

Hereinafter, an embodiment of a photoreceptor is described in detail. The photoreceptor according to the present embodiment includes: a conductive support; a charge generation layer that is disposed on the conductive support and includes a binder resin and a charge generation material; and a charge transport layer that is disposed on the charge generation layer and includes a binder resin and a charge-transporting material.

The conductive support is the same as described above.

The charge generation layer is disposed on the conductive support and includes a binder resin and a charge-generating material.

The binder resin of the charge generation layer may be, for example, an insulating resin, such as polyvinyl butyral, polyarylate (a condensed polymer of bisphenol A and phthalic acid), polycarbonate, a polyester resin, a phenoxy resin, polyvinyl acetate, an acryl resin, a polyacrylamide resin, polyamide, polyvinyl pyridine, a cellulose-based resin, a urethane resin, an epoxy resin, a silicon resin, polystyrene, polyketone, polyvinyl chloride, a vinyl chloride-a vinylic acid copolymer, polyvinyl acetal, polyacrylonitrile, a phenol resin, a melamine resin, casein, a polyvinyl alcohol, or a polyvinyl pyrrolidone, or an organic photoconductive resin, such as poly N-vinylcarbazole, polyvinyl anthracene, or polyvinylpyrene.

The charge-generating material is the same as described above. An amount of the charge-generating material may be in a range of, for example, about 50 parts by weight to about 300 parts by weight based on 100 parts by weight of the binder resin of the charge generation layer.

A solvent that is used in preparing a coating slurry for forming the charge generation layer may be any one of various solvents that dissolve the binder resin of the charge generation layer and do not affect an adjacent layer during coating for forming a charge generation layer. Examples of a possible solvent are methyl isopropyl ketone, methyl isobutyl ketone, 4-methoxy-4-methyl-2-pentanone, isopropyl acetate, tertiary butyl acetate, methyl ethyl ketone, cyclohexanone, 1,2-dichloroethane, 1,1,2-trichloroethane, 1,1,1-trichloroethane, trichloroethylene, tetrachloroethane, dichloromethane, tetrahydrofurane, dioxane, dioxolane, ethyl acetate, and butyl acetate. These solvents may be used alone or in combination thereof. In preparing a coating slurry for forming the charge generation layer, an amount of the solvent may be, for example, in a range of about 500 parts by weight to about 10,000 parts by weigh based on 100 parts by weight of a total of the charge-generating material and the binder resin.

The coating slurry for forming the charge generation layer may be coated on the conductive support. The coating method may be soaking coating, ring coating, roll coating, or spray coating. The conductive support coated with the coating slurry may be dried at a temperature of about 90 to about 200° C. for about 0.1 to about 2 hours to form a charge generation layer.

A thickness of the charge generation layer may be in a range of, for example, about 0.001 to about 10 μm, about 0.01 to about 10 μm, or about 0.05 to about 3 μm. When a thickness of the charge generation layer is too small, charges may not be efficiently generated, and when a thickness of the charge generation layer is too great, charges may not be moved well and may be trapped, thereby leading to a decrease in image quality.

The charge transport layer may be disposed on the charge generation layer. Accordingly, the charge transport layer constitutes a surface of the photoreceptor. The charge transport layer includes a binder resin and a charge-transporting material.

The charge-transporting material is the same as described above. An amount of the charge-transporting material may be in a range of, for example, about 10 parts by weight to about 100 parts by weight based on 100 parts by weight of the binder resin of the charge transport layer.

The binder resin of the charge transport layer includes the first binder resin that contains a repeating unit represented by Formula 1 and the second binder resin that does not contain the repeating unit represented by Formula 1.

The first binder resin is already described above.

The second binder resin is already described above.

A weight ratio of the first binder resin to the second binder resin in the charge transport layer may be in a range of about 5:5 to about 9:1. In detail, the weight ratio of the first binder resin to the second binder resin may be in a range of about 6:4 to about 8:2. When the amount of the first binder resin is too high, the photoreceptor may have too small a surface frictional force of, for example, less than about 30 gf. When the amount of the first binder resin is too low, the photoreceptor may have too high a surface frictional force of, for example about, more than 100 gf.

A solvent that is used in preparing a coating slurry for forming the charge transport layer may be any one of various solvents that dissolve the binder resin of the charge transport layer and do not affect an adjacent layer during coating for forming a charge transport layer. Examples of a possible solvent are methyl isopropyl ketone, methyl isobutyl ketone, 4-methoxy-4-methyl-2-pentanone, isopropyl acetate, tertiary butyl acetate, methyl ethyl ketone, cyclohexanone, 1,2-dichloroethane, 1,1,2-trichloroethane, 1,1,1-trichloroethane, trichloroethylene, tetrachloroethane, dichloromethane, tetrahydrofurane, dioxane, dioxolane, ethyl acetate, and butyl acetate. These solvents may be used alone or in combination thereof. In preparing a coating slurry for forming the charge transport layer, an amount of the solvent may be, for example, in a range of about 500 parts by weight to about 1,000 parts by weight based on 100 parts by weight of a total of the charge-transporting material and the binder resin.

The coating slurry for forming the charge transport layer may be coated on the charge generation layer. The coating method may be soaking coating, ring coating, roll coating, or spray coating. The conductive support coated with the coating slurry may be dried at a temperature of about 90 to about 200° C. for about 0.1 to about 2 hours to form a charge transport layer.

A thickness of the charge transport layer may be in a range of, for example, about 1 to about 50 μm, about 10 to about 40 μm, or about 15 to about 40 μm. When a thickness of the charge transport layer is too small, charges may not be efficiently generated, and when a thickness of the charge transport layer is too great, charges may not be moved well and may be trapped, thereby leading to a decrease in image quality. A smaller thickness of the charge transport layer may lead to a higher image quality. However, when a thickness of the charge transport layer is too small, due to wear caused by use, a lifespan of the charge transport layer may be reduced. A greater thickness of the charge transport layer may lead to a longer lifespan. However, when the thickness of the charge transport layer is too great, generated charges may not be moved well and may be trapped, and thus, image quality may be lowered.

Hereinafter, an embodiment of a photoreceptor is described in detail. The photoreceptor according to the present embodiment includes a conductive support; and a charge transport layer that is disposed on the conductive support and includes a binder resin and a charge transporting material; and a charge generation layer that is disposed on the charge transport layer and includes a binder resin and a charge generating material.

The conductive support is the same as described above.

The charge transport layer is disposed on the conductive support and includes a binder resin and a charge-transporting material.

The binder resin of the charge transport layer may be, for example, an insulating resin, such as polyvinyl butyral, polyarylate (a condensed polymer of bisphenol A and phthalic acid), polycarbonate, a polyester resin, a phenoxy resin, polyvinyl acetate, an acryl resin, a polyacrylamide resin, a polyamide, polyvinyl pyridine, a cellulose-based resin, a urethane resin, an epoxy resin, a silicon resin, polystyrene, polyketone, polyvinyl chloride, a vinyl chloride-a vinylic acid copolymer, polyvinyl acetal, polyacrylonitrile, a phenol resin, a melamine resin, casein, a polyvinyl alcohol, or a polyvinyl pyrrolidone, or an organic photoconductive resin, such as poly N-vinylcarbazole, polyvinyl anthracene, or polyvinylpyrene.

A charge-transporting material is the same as described above. An amount of the charge-transporting material may be in a range of, for example, about 10 parts by weight to about 60 parts by weight based on 100 parts by weight of the binder resin of the charge transport layer.

A solvent that is used in preparing a coating slurry for forming the charge transport layer may be any one of various solvents that dissolve the binder resin of the charge transport layer and do not affect an adjacent layer during coating for forming a charge transport layer. Examples of a possible solvent are methyl isopropyl ketone, methyl isobutyl ketone, 4-methoxy-4-methyl-2-pentanone, isopropyl acetate, tertiary butyl acetate, methyl ethyl ketone, cyclohexanone, 1,2-dichloroethane, 1,1,2-trichloroethane, 1,1,1-trichloroethane, trichloroethylene, tetrachloroethane, dichloromethane, tetrahydrofurane, dioxane, dioxolane, ethyl acetate, and butyl acetate. These solvents may be used alone or in combination thereof. In preparing a coating slurry for forming the charge transport layer, an amount of the solvent may be, for example, in a range of about 500 parts by weight to about 1,000 parts by weight based on 100 parts by weight of a total of the charge-transporting material and the binder resin.

The coating slurry for forming the charge transport layer may be coated on the conductive support. The coating method may be soaking coating, ring coating, roll coating, or spray coating. The conductive support coated with the coating slurry may be dried at a temperature of about 90 to about 200° C. for about 0.1 to about 2 hours to form a charge transport layer.

A thickness of the charge transport layer may be in a range of, for example, about 1 to about 50 μm, about 10 to about 40 μm, or about 15 to about 40 μm. When a thickness of the charge transport layer is too small, charges may not be efficiently generated, and when a thickness of the charge transport layer is too great, charges may not be moved well and may be trapped, thereby leading to a decrease in image quality. A smaller thickness of the charge transport layer may lead to a higher image quality. However, when a thickness of the charge transport layer is too small, due to wear caused by use, a lifespan of the charge transport layer may be reduced. A greater thickness of the charge transport layer may lead to a longer lifespan. However, when the thickness of the charge transport layer is too great, generated charges may not be moved well and may be trapped, and thus, image quality may be lowered.

The charge generation layer may be disposed on the charge transport layer. Accordingly, the charge generation layer constitutes a surface of the photoreceptor. The charge generation layer includes a binder resin and a charge-generating material.

The charge-generating material is the same as described above. An amount of the charge-generating material may be in a range of, for example, about 50 parts by weight to about 300 parts by weight based on 100 parts by weight of the binder resin of the charge generation layer.

The binder resin of the charge generation layer includes the first binder resin that contains a repeating unit represented by Formula 1 and the second binder resin that does not contain the repeating unit represented by Formula 1.

The first binder resin is already described above.

The second binder resin is already described above.

A weight ratio of the first binder resin to the second binder resin in the charge generation layer may be in a range of about 5:5 to about 9:1. In detail, the weight ratio of the first binder resin to the second binder resin may be in a range of about 6:4 to about 8:2. When the amount of the first binder resin is too high, the photoreceptor may have too small a surface frictional force of, for example, less than about 30 gf. When the amount of the first binder resin is too low, the photoreceptor may have too high a surface frictional force of, for example about, more than 100 gf.

A solvent that is used in preparing a coating slurry for forming the charge generation layer may be any one of various solvents that dissolve the binder resin of the charge generation layer and do not affect an adjacent layer during coating for forming a charge generation layer. Examples of a possible solvent are methyl isopropyl ketone, methyl isobutyl ketone, 4-methoxy-4-methyl-2-pentanone, isopropyl acetate, tertiary butyl acetate, methyl ethyl ketone, cyclohexanone, 1,2-dichloroethane, 1,1,2-trichloroethane, 1,1,1-trichloroethane, trichloroethylene, tetrachloroethane, dichloromethane, tetrahydrofurane, dioxane, dioxolane, ethyl acetate, and butyl acetate. These solvents may be used alone or in combination thereof. In preparing a coating slurry for forming the charge generation layer, an amount of the solvent may be, for example, in a range of about 500 parts by weight to about 10,000 parts by weight based on 100 parts by weight of a total of the charge-generating material and the binder resin.

The coating slurry for forming the charge generation layer may be coated on the charge transport layer. The coating method may be soaking coating, ring coating, roll coating, or spray coating. The conductive support coated with the coating slurry may be dried at a temperature of about 90 to about 200° C. for about 0.1 to about 2 hours to form a charge generation layer.

A thickness of the charge generation layer may be in a range of, for example, about 0.001 to about 10 μm, about 0.01 to about 10 μm, or about 0.05 to about 3 μm. When a thickness of the charge generation layer is too small, charges may not be efficiently generated, and when a thickness of the charge generation layer is too great, charges may not be moved well and may be trapped, thereby leading to a decrease in image quality.

Regarding the photoreceptors according to the embodiments, due to the inclusion of a binder including the first binder resin that contains the repeating unit represented by Formula 1 and the second binder resin that does not contain the repeating unit represented by Formula 1 in a layer disposed on the surface of a photoreceptor, the surface of the photoreceptor may have a desired level of frictional force. When the photoreceptor has an appropriate level of surface frictional force, a cleaning angle, at which slipping between the surface of the photoreceptor surface and a blade is prevented and also, overturning and vibrating of the blade is prevented, may be very easily obtained.

Figure 2:
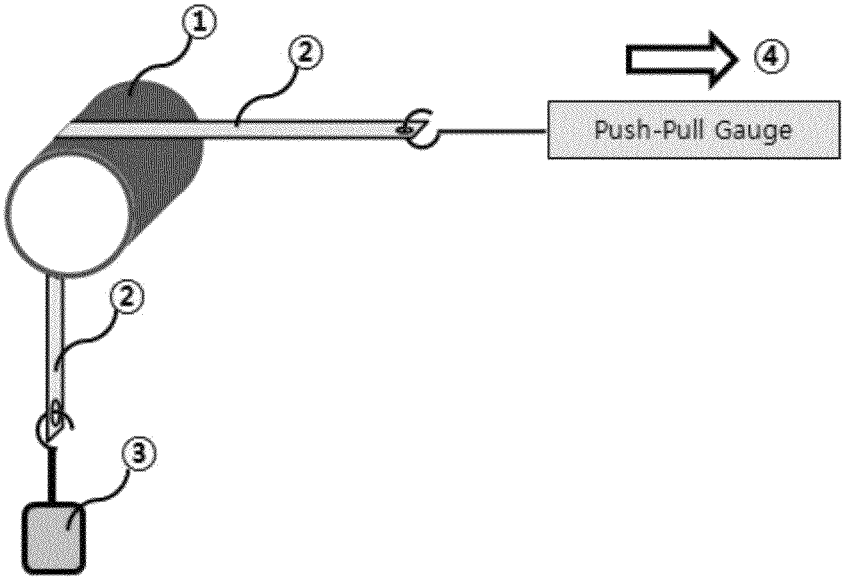
FIG. 2 is an illustrative view of a device for measuring a surface frictional force.

The frictional force of the surface of photoreceptor is measured by using a device for measuring a surface frictional force of FIG. 2. FIG. 2 is an illustrative view of a device for measuring a surface frictional force. A photoreceptor 1 is fixed, and then, 170 g of a weight 3 was attached to a Teflon film 2 (thickness of 0.08 mm, width of 20 mm, and length of 400 mm), and the Teflon film 2 was moved in a movement direction 4 at a movement speed of 108 mm/min by a movement distance of 40 mm. A force value shown on a push-pull gauge is defined as a photoreceptor surface frictional force.

Regarding the photoreceptors according to the first through third photoreceptors, a photoreceptor surface frictional force may be, for example, in a range of about 30 gf to about 100 gf. For example, the photoreceptor surface frictional force may be, for example, in a range of about 50 gf to about 80 gf. When the photoreceptor surface frictional force is too small, at some cleaning angles (for example, from about 6° degrees to about 15 degrees°), slipping may occur between the photoreceptor surface and a blade and thus, the residual ink or toner is not removed. In addition, slipping occurs between a charging roller and a photoreceptor, and thus, image defects due to defective charging may occur. When the photoreceptor surface frictional force is too great, a blade may overturn or vibrate very easily. The vibration of the blade causes noise.

Hereinafter, the electro-photographic image forming apparatus is described in detail. According to an embodiment of an electro-photographic image forming apparatus includes a photoreceptor and a cleaning blade, wherein the photoreceptor is one of the photoreceptors according to the first to third aspects of the present general inventive concept.

The photoreceptor is the same as described above.

Referring to FIG. 1, a cylindrical photoreceptor 100 contacts a front end of cleaning a blade 200 at a position C. The cleaning blade 200 is fixed on a support 300. A dashed line A is an extension line of a straight portion of the cleaning blade 200. A dashed line B contacts the photoreceptor 100 through the position C. An angle (that is, a cleaning angle) formed by the cylindrical photoreceptor 100 and the cleaning blade 200 is defined as an angle (θ) formed by the dashed line A and a dashed line B. The cleaning angle may be in a range of, for example, about 6° to about 15°. In detail, for example, the cleaning angle may be in a range of, for example, about 7° to about 12°. At a greater angle, the residual ink or toner is more easily removed. However, when the angle exceeds a certain range, the blade 200 may overturn, or deform or vibrate, leading to failure in the removal.

EXAMPLE

Preparation Example 1

Formation of Charge Generation Layer on Conductive Support

An aluminum drum (a cylindrical drum having a diameter of 24 mm and a length of 248 mm) was used as a conductive support.

5 parts by weight of nylon resin (CM8000, Toray Industries, Inc.), which dissolves in alcohol, was dissolved in 90 parts by weight of methanol, and then, mixed with 5 parts by weight of titania ($TiO_2$) treated with aminosilane. The mixture was subjected to sand-milling for 2 hours and then, dispersed with ultrasonic waves. The obtained solution was immersion-coated on the aluminum drum and then dried at a temperature of 80° C. for 20 minutes to prepare an under coated layer (UCL).

20 parts by weight of a charge-generating material (y-TiOPc, titanyloxy phthalocyanine), 13 parts by weight of poly(vinyl butyral) (PVB) (Japan Sekisui Chemical Co., Ltd., BX-1, weight average molecular amount of 100,000 to 130,000) that was used as a binder resin for a charge generation layer, and 635 parts by weight of solvent (tetrahydrofurane) were mixed by sand-milling for 2 hours and then dispersed with ultrasonic waves to prepare a slurry for forming a charge generation layer.

The slurry for forming a charge generation layer was immersion-coated on the drum with an UCL coated thereon, and then dried at a temperature of 120° C. for 20 minutes to form a charge generation layer (thickness: 0.3 μm).

Preparation of a Binder Resin

A monomer was prepared in an emulsion state by dissolving the monomer in a mixed solution obtained by mixing methylene chloride and a 5 to 10 wt % NaOH aqueous solution (pH 12) at a volumetric ratio of 1:2. Then, triethylamine that was a reaction catalyst was added thereto and the mixture was stirred at a temperature of 30° C. for 12 hours, and then a small amount of phenol was added thereto to stop the reaction. When the reaction was completed, the reaction solution was neutralized by using a hydrochloric acid aqueous solution to perform phase-separation, and then a methylene chloride layer was separated therefrom and washed several times with ultrapure water, followed by evaporation, thereby obtaining a binder resin. Characteristics of various binder resins obtained from various monomers are as follows:

Second Binder Resin 1

Monomer used: Bisphenol A (Tokyo Chemical Industry Co., Ltd.)

Formula

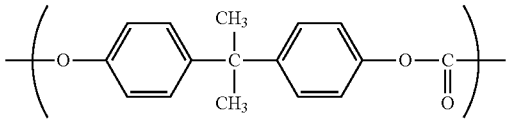

Weight average molecular weight: 50,000

Second Binder Resin 2

Monomer used: Bisphenol Z (Tokyo Chemical Industry Co., Ltd.)

Formula

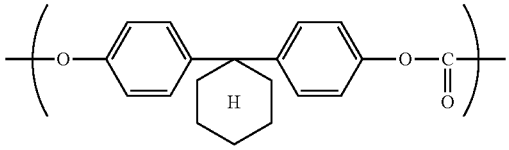

Weight average molecular weight: 48,000

Preparation Example of Second Binder Resin 3

Monomer used: 4,4'-(3,3,5-trimethylcyclohexylidene) bisphenol (Shanghai Chemmole Co., Ltd)

Formula

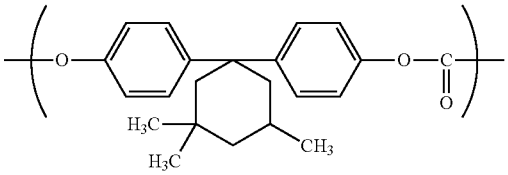

Weight average molecular weight: 53,000

Preparation Example of Second Binder Resin 4

Monomer used: Bisphenol A (Tokyo Chemical Industry Co., Ltd.); 4,4'-Biphenol (Tokyo Chemical Industry Co., Ltd.)

-Formula:

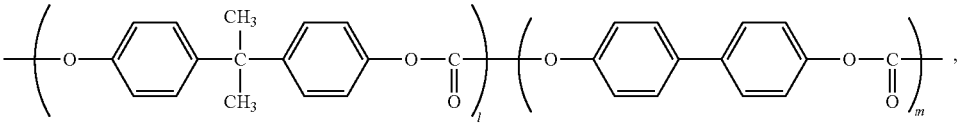

wherein l:m=85:15

Weight average molecular weight: 51,000

Preparation Example of Second Binder Resin 5

Monomer used: Bisphenol A (Tokyo Chemical Industry Co., Ltd.); Bisphenol Z (Tokyo Chemical Industry Co., Ltd.)

-Formula:

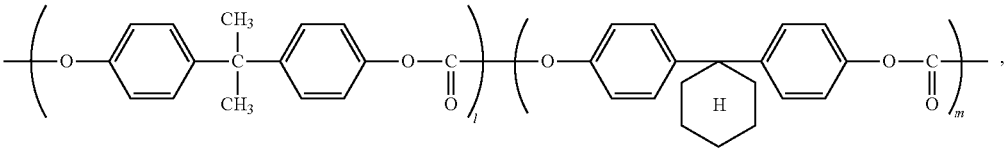

wherein l:m=85:15

Weight average molecular weight: 50,000

Preparation Example of Second Binder Resin 6

Monomer used: Bisphenol A (Tokyo Chemical Industry Co., Ltd.); 4,4'-(3,3,5-trimethylcyclohexylidene) bisphenol (Shanghai Chemmole Co., Ltd.)

-Formula:

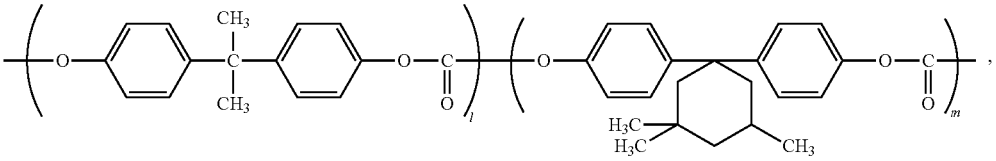

wherein l:m=85:15

Weight average molecular weight: 53,000

Preparation Example of Second Binder Resin 7

Monomer used: Bisphenol Z (Tokyo Chemical Industry Co., Ltd.); 4,4'-(3,3,5-trimethylcyclohexylidene) bisphenol (Shanghai Chemmole Co., Ltd.)

-Formula:

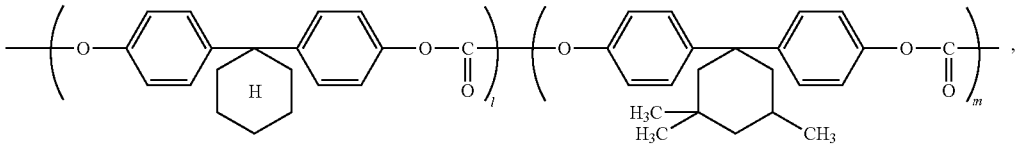

wherein l:m=85:15

Weight average molecular weight: 50,000

Preparation Example of Second Binder Resin 8

Monomer used: Bisphenol Z (Tokyo Chemical Industry Co., Ltd.); 4,4'-Biphenol (Tokyo Chemical Industry Co., Ltd.)

-Formula:

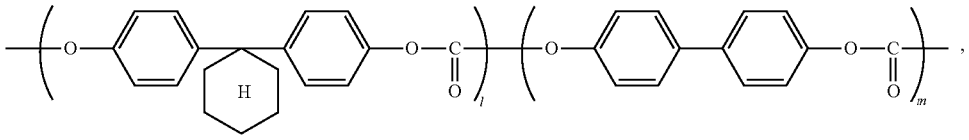

wherein l:m=85:15

Weight average molecular weight: 55,000

Preparation Example of First Binder Resin 9 (Corresponding to Formula 2)

Monomer used: Bisphenol A (Tokyo Chemical Industry Co., Ltd.); 4,4'-Biphenol (Tokyo Chemical Industry Co., Ltd.); Polydialkylsiloxane (see S below)

-Formula:

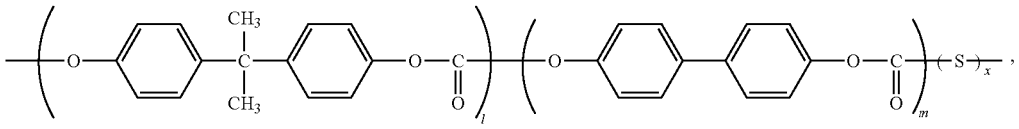

wherein l:m:x=85:15:0.015,

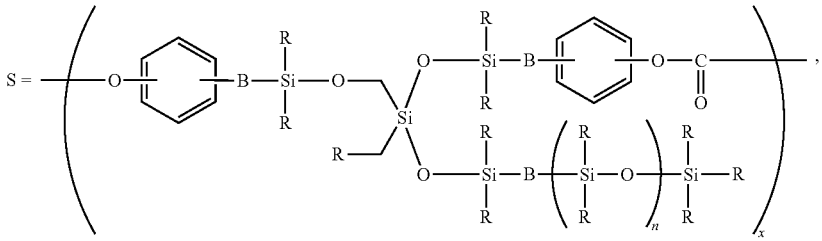

$R=CH_3$, $B=(CH_3)_2$, n=25

Weight average molecular weight: 52,000

Preparation Example of First Binder Resin 11 (Corresponding to Formula 4)

Monomer used: Bisphenol A (Tokyo Chemical Industry Co., Ltd.); 4,4'-Biphenol (Tokyo Chemical Industry Co., Ltd.); Polydialkylsiloxane (see S below)

-Formula:

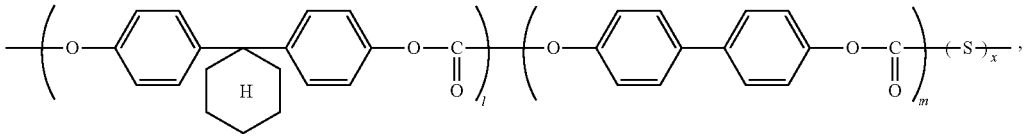

wherein l:m:x=85:15:0.015,

Charge-transporting material D:

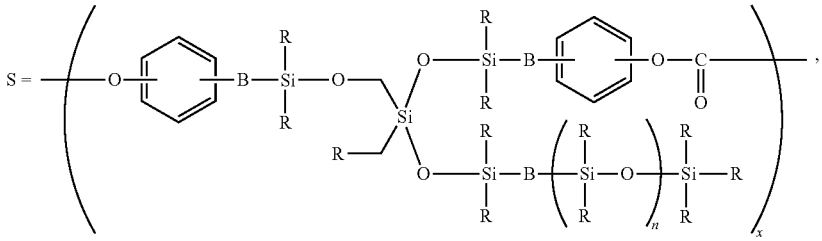

$R=CH_3$, $B=(CH_3)_2$, n=25

Weight average molecular weight: 51,000

Comparative Example 1

30 parts by weight of a charge-transporting material (a mixture including a charge-transporting material C and a charge-transporting material D at a weight ratio of 1:1) and 50 parts by weight of a second binder resin 1 (PCA) were dissolved in 360 parts by weight of a THF/toluene co-solvent (a weight ratio of 4:1) to prepare a coating composition for forming a charge transport layer. "The conductive support including the charge generation layer" obtained according to Preparation Example 1 was immersed in the coating composition for forming a charge transport layer to coat the coating composition on the conductive support, and then, dried at a temperature of 120° C. for 30 minutes to form a charge transport layer. A thickness of a photoreceptor layer (including the charge generation layer and the charge transport layer) was 20 μm.

Charge-transporting material C:

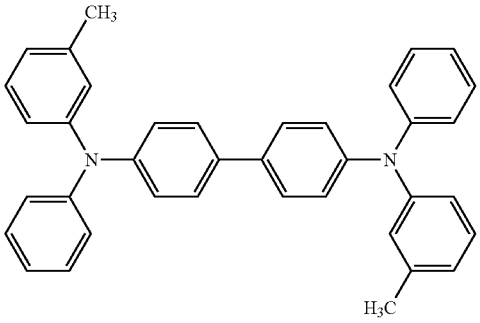

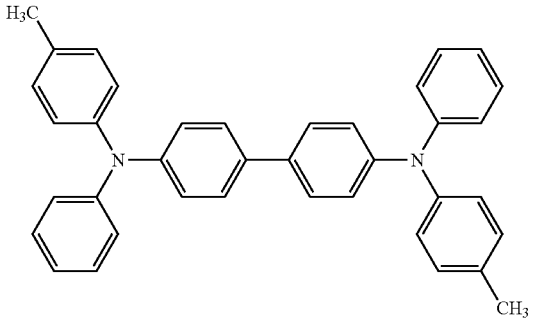

Comparative Example 2

A charge transport layer was formed on the "conductive support including the charge generation layer" obtained according to Preparation Example 1 in the same manner as in Comparative Example 1 except that the second binder resin 2 was used.

Comparative Example 3

A charge transport layer was formed on "the conductive support including the charge generation layer" obtained according to Preparation Example 1 in the same manner as in Comparative Example 1 except that the second binder resin 3 was used.

Comparative Example 4

A charge transport layer was formed on "the conductive support including the charge generation layer" obtained according to Preparation Example 1 in the same manner as in Comparative Example 1 except that the second binder resin 4 was used.

Comparative Example 5

A charge transport layer was formed on "the conductive support including the charge generation layer" obtained according to Preparation Example 1 in the same manner as in Comparative Example 1 except that the second binder resin 5 was used.

Comparative Example 6

A charge transport layer was formed on "the conductive support including the charge generation layer" obtained according to Preparation Example 1 in the same manner as in Comparative Example 1 except that the second binder resin 6 was used.

Comparative Example 7

A charge transport layer was formed on "the conductive support including the charge generation layer" obtained according to Preparation Example 1 in the same manner as in Comparative Example 1 except that the second binder resin 7 was used.

Comparative Example 8

A charge transport layer was formed on "the conductive support including the charge generation layer" obtained according to Preparation Example 1 in the same manner as in Comparative Example 1 except that the second binder resin 8 was used.

Comparative Example 9

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 9 were used at a weight ratio of 4:6.

Comparative Example 10

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 11 were used at a weight ratio of 4:6.

Comparative Example 11

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 9 were used at a weight ratio of 4:6.

Comparative Example 12

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 11 were used at a weight ratio of 4:6.

Comparative Example 13

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 9 were used at a weight ratio of 4:6.

Comparative Example 14

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 11 were used at a weight ratio of 4:6.

Example 1

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 9 were used at a weight ratio of 9:1.

Example 2

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 9 were used at a weight ratio of 8:2.

Example 3

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 9 were used at a weight ratio of 7:3.

Example 4

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 9 were used at a weight ratio of 6:4.

Example 5

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 9 were used at a weight ratio of 5:5.

Example 6

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 11 were used at a weight ratio of 9:1.

Example 7

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 11 were used at a weight ratio of 8:2.

Example 8

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 11 were used at a weight ratio of 7:3.

Example 9

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 11 were used at a weight ratio of 6:4.

Example 10

A charge transport layer was formed on "the conductive support including the charge generation layer" obtained according to Preparation Example 1 in the same manner as in Comparative Example 1 except that for use as a binder resin for a charge transport layer, the second binder resin 2 and the first binder resin 11 were used at a weight ratio of 5:5.

Example 11

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 9 were used at a weight ratio of 9:1.

Example 12

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 9 were used at a weight ratio of 8:2.

Example 13

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 9 were used at a weight ratio of 7:3.

Example 14

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 9 were used at a weight ratio of 6:4.

Example 15

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 9 were used at a weight ratio of 5:5.

Example 16

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 11 were used at a weight ratio of 9:1.

Example 17

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 11 were used at a weight ratio of 8:2.

Example 18

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 11 were used at a weight ratio of 7:3.

Example 19

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 11 were used at a weight ratio of 6:4.

Example 20

A charge transport layer was formed on "the conductive support including the charge generation layer" obtained according to Preparation Example 1 in the same manner as in Comparative Example 1 except that for use as a binder resin for a charge transport layer, the second binder resin 4 and the first binder resin 11 were used at a weight ratio of 5:5.

Example 21

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 9 were used at a weight ratio of 9:1.

Example 22

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 9 were used at a weight ratio of 8:2.

Example 23

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 9 were used at a weight ratio of 7:3.

Example 24

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 9 were used at a weight ratio of 6:4.

Example 25

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 9 were used at a weight ratio of 5:5.

Example 26

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 11 were used at a weight ratio of 9:1.

Example 27

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 11 were used at a weight ratio of 8:2.

Example 28

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 11 were used at a weight ratio of 7:3.

Example 29

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 11 were used at a weight ratio of 6:4.

Example 30

A charge transport layer was formed on "the conductive support including the charge generation layer" obtained according to Preparation Example 1 in the same manner as in Comparative Example 1 except that for use as a binder resin for a charge transport layer, the second binder resin 8 and the first binder resin 11 were used at a weight ratio of 5:5.

<Surface Frictional Force Measurement Results>

The surface frictional force of the photoreceptors prepared according to Comparative Examples 1-14 and Examples 1-30 were measured. Results thereof are shown in Table 1.

TABLE 1

| Sample | Measurement value 1 (gf) | Measurement value 2 (gf) | Measurement value 3 (gf) | Average (gf) |
|---|---|---|---|---|
| Comparative Example 1 | 135 | 141 | 140 | 139 |
| Comparative Example 2 | 138 | 135 | 140 | 138 |
| Comparative Example 3 | 130 | 132 | 131 | 131 |
| Comparative Example 4 | 120 | 118 | 110 | 116 |
| Comparative Example 5 | 140 | 142 | 141 | 141 |
| Comparative Example 6 | 142 | 145 | 143 | 143 |
| Comparative Example 7 | 136 | 137 | 133 | 135 |
| Comparative Example 8 | 142 | 140 | 145 | 142 |
| Comparative Example 9 | 22 | 24 | 25 | 24 |
| Comparative Example 10 | 24 | 23 | 23 | 23 |
| Comparative Example 11 | 19 | 22 | 22 | 21 |
| Comparative Example 12 | 24 | 25 | 25 | 25 |
| Comparative Example 13 | 23 | 22 | 22 | 22 |
| Comparative Example 14 | 18 | 22 | 25 | 22 |
| Example 1 | 104 | 100 | 98 | 101 |
| Example 2 | 82 | 76 | 78 | 79 |
| Example 3 | 72 | 67 | 69 | 69 |
| Example 4 | 52 | 48 | 55 | 52 |
| Example 5 | 35 | 34 | 32 | 34 |
| Example 6 | 100 | 99 | 99 | 99 |
| Example 7 | 80 | 80 | 78 | 79 |
| Example 8 | 66 | 68 | 65 | 66 |
| Example 9 | 50 | 45 | 48 | 48 |
| Example 10 | 30 | 28 | 33 | 30 |
| Example 11 | 103 | 100 | 98 | 100 |
| Example 12 | 83 | 80 | 78 | 80 |
| Example 13 | 70 | 70 | 68 | 69 |

TABLE 1-continued

| Sample | Measurement value 1 (gf) | Measurement value 2 (gf) | Measurement value 3 (gf) | Average (gf) |
|---|---|---|---|---|
| Example 14 | 50 | 48 | 51 | 50 |
| Example 15 | 33 | 32 | 32 | 32 |
| Example 16 | 98 | 100 | 105 | 101 |
| Example 17 | 85 | 84 | 86 | 85 |
| Example 18 | 65 | 64 | 64 | 64 |
| Example 19 | 48 | 46 | 46 | 47 |
| Example 20 | 32 | 34 | 34 | 33 |
| Example 21 | 96 | 97 | 97 | 97 |
| Example 22 | 82 | 80 | 76 | 79 |
| Example 23 | 66 | 66 | 68 | 67 |
| Example 24 | 54 | 50 | 48 | 51 |
| Example 25 | 30 | 28 | 33 | 30 |
| Example 26 | 98 | 95 | 95 | 96 |
| Example 27 | 80 | 78 | 76 | 78 |
| Example 28 | 68 | 68 | 67 | 68 |
| Example 29 | 50 | 55 | 54 | 53 |
| Example 30 | 30 | 28 | 33 | 30 |

Cleaning Performance Evaluation

Cleaning performance evaluation results of the photoreceptors prepared according to the comparative examples and the examples are shown in Tables 2 to 7.

Photoreceptor Surface Frictional Force: 110 gf or More (Comparative Examples 1 to 8)

TABLE 2

| Cleaning angle (°) | Blade overturning | Noise caused by vibration | Removal of residual toner |
|---|---|---|---|
| 6 | not occurred | not occurred | not removed |
| 7 | not occurred | not occurred | not removed |
| 8 | occurred | not occurred | — |
| 9 | occurred | occurred | — |
| 12 | occurred | occurred | — |
| 15 | occurred | occurred | — |

Photoreceptor Surface Frictional Force: 25 gf or Less (Comparative Examples 9 to 14)

TABLE 3

| Cleaning angle (° °) | Blade overturning | Noise caused by vibration | Removal of residual toner |
|---|---|---|---|
| 6 | not occurred | not occurred | not removed |
| 7 | not occurred | not occurred | not removed |
| 8 | not occurred | not occurred | not removed |
| 9 | not occurred | not occurred | not removed |
| 12 | not occurred | not occurred | not removed |
| 15 | not occurred | not occurred | removed |

Photoreceptor Surface Frictional Force: 30 to 35 gf (Examples 5, 10, 15, 20, 25, and 30)

TABLE 4

| Cleaning angle (° °) | Blade overturning | Noise caused by vibration | Removal of residual toner |
|---|---|---|---|
| 6 | not occurred | not occurred | Removed (some remained) |
| 7 | not occurred | not occurred | removed |
| 8 | not occurred | not occurred | removed |
| 9 | not occurred | not occurred | removed |
| 12 | not occurred | not occurred | removed |
| 15 | not occurred | not occurred | removed |

Photoreceptor Surface Frictional Force: 47 to 69 gf (Examples 3, 4, 8, 9, 13, 14, 18, 19, 23, 24, 28, and 29)

TABLE 5

| Cleaning angle (°) | Blade overturning | Noise caused by vibration | Removal of residual toner |
|---|---|---|---|
| 6 | not occurred | not occurred | removed |
| 7 | not occurred | not occurred | removed |
| 8 | not occurred | not occurred | removed |
| 9 | not occurred | not occurred | removed |
| 12 | not occurred | not occurred | removed |
| 15 | not occurred | not occurred | removed |

Photoreceptor Surface Frictional Force: 78 to 85 gf (Examples 2, 7, 12, 17, 22, and 27)

TABLE 6

| Cleaning angle (°) | Blade overturning | Noise caused by vibration | Removal of residual toner |
|---|---|---|---|
| 6 | not occurred | not occurred | removed |
| 7 | not occurred | not occurred | removed |
| 8 | not occurred | not occurred | removed |
| 9 | not occurred | not occurred | removed |
| 12 | not occurred | not occurred | removed |
| 15 | not occurred | not occurred | removed |

Photoreceptor Surface Frictional Force: 96 to 101 gf (Examples 1, 6, 11, 16, 21, and 26)

TABLE 7

| Cleaning angle (°) | Blade overturning | Noise caused by vibration | Removal of residual toner |
|---|---|---|---|
| 6 | not occurred | not occurred | removed |
| 7 | not occurred | not occurred | removed |
| 8 | not occurred | not occurred | removed |
| 9 | not occurred | not occurred | removed |
| 12 | not occurred | not occurred | removed |
| 15 | occurred | not occurred | — |

A first binder resin containing a repeating unit represented by Formula 1 reduces a frictional force. A frictional force caused by a second binder resin that does not contain the repeating unit represented by Formula 1 may be reduced due to the first binder resin that contains the repeating unit represented by Formula 1. Accordingly, due to the inclusion of a binder including the first binder resin that contains the repeating unit represented by Formula 1 and the second binder resin that does not contain the repeating unit represented by Formula 1 in a layer disposed on the surface of a photoreceptor, the surface of the photoreceptor may have a desired level of frictional force. When the photoreceptor has an appropriate level of surface frictional force, a cleaning angle, at which slipping between the surface of the photoreceptor surface and a blade is prevented and also, overturning and vibrating of the blade is prevented, may be very easily obtained.

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A photoreceptor comprising:

a conductive support; and a photoreceptor layer that is disposed as a single layer on a surface of the conductive support comprising a charge-generating material, a charge-transporting material, and a binder resin, wherein the binder resin comprises a first binder resin that contains a repeating unit represented by Formula 1 and a second binder resin that does not contain the repeating unit represented by Formula 1:

<Formula 1>

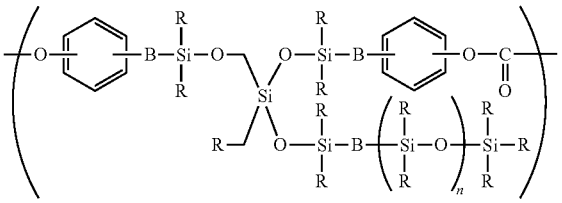

wherein the respective R are each independently a C1 to C6 alkyl group, a C1 to C6 alkenyl group, a C1 to C6 alkynyl group, or a C6 to C11 aryl group, B is —$(CH_2)_z$—, Z is 2 to 6, and n is 0 to 200.

2. The photoreceptor of claim 1, wherein the first binder resin is a binder resin represented by Formula 2 below, a binder resin represented by Formula 3 below, a binder resin represented by Formula 4 below, or a mixture thereof:

<Formula 2>

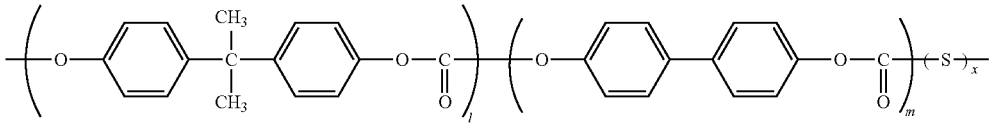

<Formula 3>

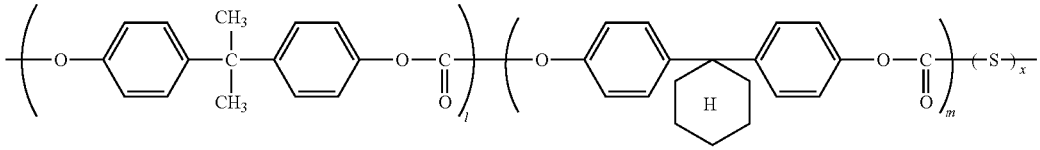

<Formula 4>

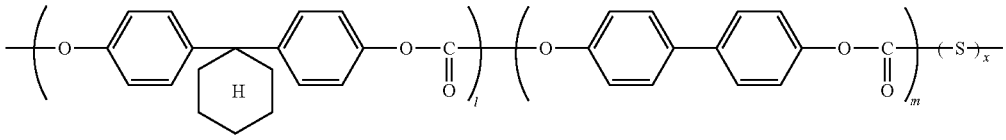

in Formulae 2, 3, and 4, S is the repeating unit represented by Formula 1, and x/(l+m+x) is in a range of about 0.001 to about 0.01.

3. The photoreceptor of claim 1, wherein a weight ratio of the first binder resin to the second binder resin in the photoreceptor layer is in a range of 5:5 to 9:1.

4. The photoreceptor of claim 1, wherein a surface frictional force of the photoreceptor is in a range of about 30 gf to about 100 gf.

5. The photoreceptor of claim 1, wherein a surface frictional force of the photoreceptor is in a range of about 50 gf to about 80 gf.

6. The photoreceptor of claim 1 further comprising a cleaning blade of an electro-photographic image forming apparatus.

7. The photoreceptor of claim 6, wherein an angle between the photoreceptor and the cleaning blade is in a range of about 6° to about 15°.

8. The photoreceptor of claim 6, wherein an angle between the photoreceptor and the cleaning blade is in a range of about 7° to about 12°.

9. A photoreceptor comprising:

a conductive support;

a charge generation layer that is disposed on the conductive support comprising a binder resin and a charge-generating material; and a charge transport layer that is disposed on the charge generation layer comprising a binder resin and a charge-transporting material, wherein the binder resin of the charge transport layer comprises a first binder resin that contains a repeating unit represented by Formula 1 and a second binder resin that does not contain the repeating unit represented by Formula 1:

<Formula 1>

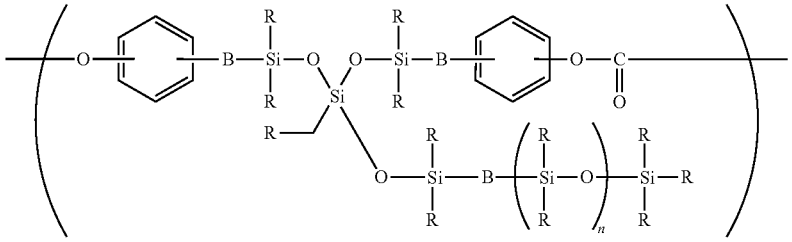

wherein the respective R are each independently a C1 to C6 alkyl group, a C1 to C6 alkenyl group, a C1 to C6 alkynyl group, or a C6 to C11 aryl group, B is —$(CH_2)_z$—, Z is 2 to 6, and n is 0 to 200, and wherein a surface frictional force of the photoreceptor is in a range of about 30 gf to about 100 gf.

10. The photoreceptor of claim 9, wherein the charge generation layer has a thickness of about 0.001 to 10 μm and the charge transport layer has a thickness of about 1 to 50 μm.

11. The photoreceptor of claim 9, wherein the first binder resin is a binder resin represented by Formula 2 below, a binder resin represented by Formula 3 below, a binder resin represented by Formula 4 below, or a mixture thereof:

<Formula 2>

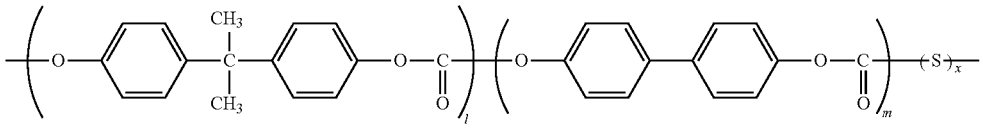

<Formula 3>

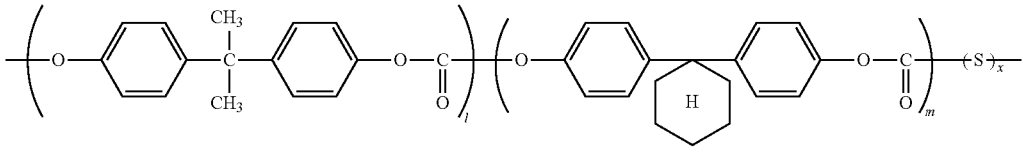

<Formula 4>

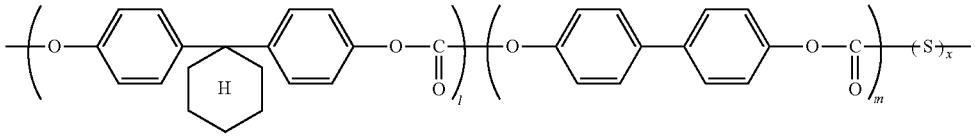

in Formulae 2, 3, and 4, S is the repeating unit represented by Formula 1, and x/(l+m+x) is in a range of about 0.001 to about 0.01.

12. The photoreceptor of claim 9, wherein a weight ratio of the first binder resin to the second binder resin in the photoreceptor layer is in a range of 5:5 to 9:1.

13. The photoreceptor of claim 9, wherein a surface frictional force of the photoreceptor is in a range of about 50 gf to about 80 gf.

14. The photoreceptor of claim 9 further comprising a cleaning blade of an electro-photographic image forming apparatus.

15. The photoreceptor of claim 14, wherein an angle between the photoreceptor and the cleaning blade is in a range of about 6° to about 15°.

16. The photoreceptor of claim 14, wherein an angle between the photoreceptor and the cleaning blade is in a range of about 7° to about 12°.

17. A photoreceptor comprising:

a conductive support;

a charge transport layer that is disposed on the conductive support comprising a binder resin and a charge-transporting material; and a charge generation layer that is disposed on the charge transport layer comprising a binder resin and a charge-generating material, wherein the binder resin of the charge generation layer comprises a first binder resin that contains a repeating unit represented by Formula 1 and a second binder resin that does not contain the repeating unit represented by Formula 1:

<Formula 1>

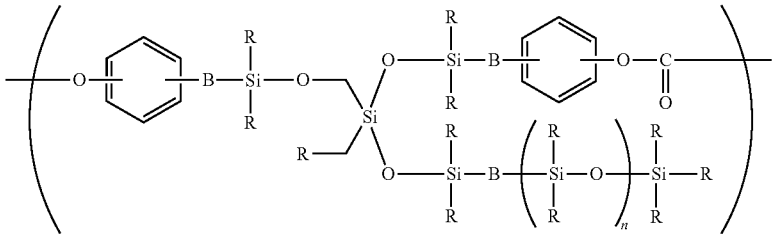

wherein the respective R are each independently a C1 to C6 alkyl group, a C1 to C6 alkenyl group, a C1 to C6 alkynyl group, or a C6 to C11 aryl group, B is —$(CH_2)_z$—, Z is 2 to 6, and n is 0 to 200.

18. The photoreceptor of claim 17, wherein the charge transport layer has a thickness of about 1 to 50 μm and the charge generation layer has a thickness of about 0.001 to 5 μm.

19. The photoreceptor of claim 17, wherein the first binder resin is a binder resin represented by Formula 2 below, a binder resin represented by Formula 3 below, a binder resin represented by Formula 4 below, or a mixture thereof:

<Formula 2>

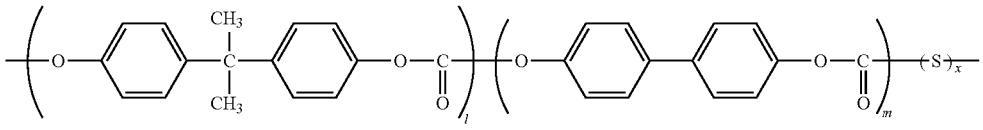

<Formula 3>

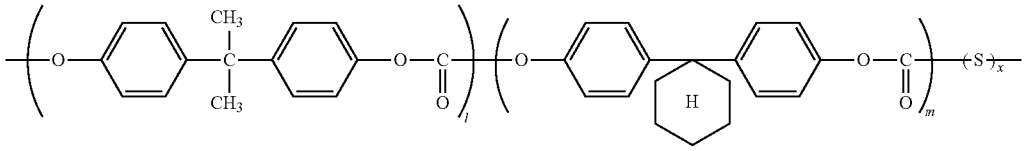

<Formula 4>

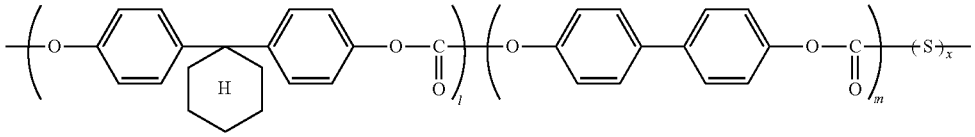

in Formulae 2, 3, and 4, S is the repeating unit represented by Formula 1, and x/(l+m+x) is in a range of about 0.001 to about 0.01.

20. The photoreceptor of claim 17, wherein a weight ratio of the first binder resin to the second binder resin in the photoreceptor layer is in a range of 5:5 to 9:1.

21. The photoreceptor of claim 17, wherein a surface frictional force of the photoreceptor is in a range of about 30 gf to about 100 gf.

22. The photoreceptor of claim 17, wherein a surface frictional force of the photoreceptor is in a range of about 50 gf to about 80 gf.

23. The photoreceptor of claim 17 further comprising a cleaning blade of an electro-photographic image forming apparatus.

24. The photoreceptor of claim 23, wherein an angle between the photoreceptor and the cleaning blade is in a range of about 6° to about 15°.

25. The photoreceptor of claim 23, wherein an angle between the photoreceptor and the cleaning blade is in a range of about 7° to about 12°.

26. A photoreceptor comprising:

a conductive support; and a photoreceptor layer that is disposed as a single layer on a surface of the conductive support comprising a charge-generating material, a charge-transporting material, and a binder resin, wherein the binder resin comprises a first binder resin that contains a repeating unit represented by Formula 1 and a second binder resin that does not contain the repeating unit represented by Formula 1:

<Formula 1>
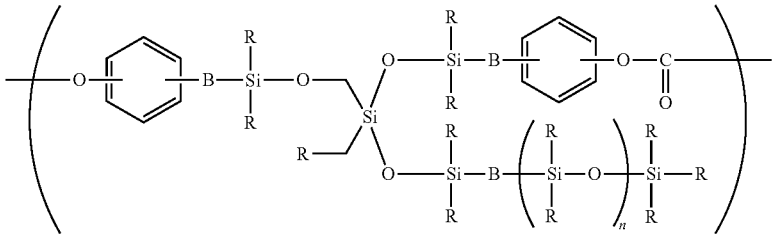
wherein the respective R are each independently a C1 to C6 alkyl group, a C1 to C6 alkenyl group, a C1 to C6 alkynyl group, or a C6 to C11 aryl group, B is —$(CH_2)_z$—, Z is 2 to 6, and n is 0 to 200;
wherein the thickness of the photoreceptor layer is about 1 to 50 μm.
* * * * *